United States Patent [19]

Kernstock

[11] Patent Number: 4,629,642

[45] Date of Patent: Dec. 16, 1986

[54] DIMENSIONALLY STABLE CARPET TILES HAVING GREIGE GOOD ADHERED TO WET-LAID COMPOSITE SHEET

[75] Inventor: John M. Kernstock, Midland, Mich.

[73] Assignee: The Dow Chemical Company, Midland, Mich.

[21] Appl. No.: 776,299

[22] Filed: Sep. 16, 1985

[51] Int. Cl.[4] ..... D03D 27/00

[52] U.S. Cl. ..... 428/95

[58] Field of Search ..... 428/95

[56] References Cited

U.S. PATENT DOCUMENTS

| | | | |
|---|---|---|---|
| 4,010,301 | 3/1977 | Anderson | 428/95 |
| 4,397,900 | 8/1983 | Higgins | 428/95 |
| 4,522,857 | 6/1985 | Higgins | 428/95 |

*Primary Examiner*—Marion C. McCamish

[57] ABSTRACT

A dimensionally stable carpet tile having a greige good adhered to an aqueous wet-laid composite sheet comprising a dimensionally stable reinforcing fiber in an amount sufficient to provide less than a 0.1 percent dimensional change of the carpet on an Aachen Test. Typical dimensionally stable reinforcing fibers are glass fibers and/or polyester fibers employed in amounts from about 2 to about 15 percent by weight based on the total composite sheet. The other main ingredients of the composite sheet comprise from about 1 to about 30 percent cellulose fibers, 2 to about 30 percent organic polymer binder material and 60 to 95 percent inorganic filler based on the total weight composite sheet. The composite sheet has an internal bond strength of at least 50 grams per inch.

8 Claims, No Drawings

DIMENSIONALLY STABLE CARPET TILES HAVING GREIGE GOOD ADHERED TO WET-LAID COMPOSITE SHEET

BACKGROUND OF THE INVENTION

Dimensional stability is one of the most important characteristics for carpet tile. Without a fully stabilized backing, problems of edge curling, buckling, bubbling or shrinkage of the tile can occur.

Generally, a carpet tile is manufactured by adhering or otherwise attaching a secondary backing to the underside of the carpet. This secondary backing can be woven scrim, composition material, or a combination of both. Typical secondary backings can be prepared with a woven reinforcement material prepared from jute, nylon, polypropylene or fiberglass. The woven reinforcement can then be covered with an adhesive or other backing material such as polyvinyl chloride urethane foams, polyethylene, ethylene vinyl acetate or an asphalt material.

Attempts to increase dimensional stability have led to the use of many materials, most common is the use of polyvinyl chloride (PVC). In such attempts, carpet tiles are manufactured by pressing a tufted or woven greige good into a molten PVC cast onto a release belt. At this time, a stabilizing scrim may be added. Problems associated with this form of secondary backing are uniformity in the application of the PVC, high energy and raw material costs, and inability to employ solvent adhesives for installation of the tiles.

Of additional concern in the preparation of carpet tiles is prevention of combustion hazards. Naturally, the incorporation of large amounts of polymeric materials into the carpet tiles increases the likelihood of smoke hazards when burned. It therefore is desirable to find better and alternative methods for providing dimensional stability to carpet tiles.

SUMMARY OF THE INVENTION

In one aspect, the present invention is directed toward a dimensionally stable carpet tile having a greige good adhered to an aqueous wet-laid composite sheet. The composite sheet characteristically comprises a dimensionally stable reinforcing fiber in an amount sufficient to provide less than a 0.10 percent dimensional change of the carpet tile on an Aachen Test. The dimensionally stable reinforcing fiber is present from about 2 to about 15 percent by weight based on the total composite sheet. Generally, the composite sheet comprises, based on the total weight composite sheet, from about 1 to about 30 percent cellulose fibers, from about 2 to about 30 percent organic polymer binder material and from about 60 to about 95 percent inorganic filler. The composite sheet has an internal bond strength of at least 50 g per inch.

Generally, the carpet tile is constructed from a greige good adhered to a composite sheet from about 0.1 to about 2.5 mm mills in gauge. Typically, the dimensionally stable reinforcing fiber is a glass fiber and the glass fiber is present from about 2 to about 10 percent by weight based on the total composite sheet and from about 2 to about 15 percent by weight cellulose fibers based on the total weight of the composite sheet.

The present invention provides for the manufacture of a dimensionally stable piece of carpet which can be die cut into tiles. These tiles have the usability of conventional polyvinyl chloride backed carpets but at an economic advantage. Further, the tiles prepared by the subject invention can have low polymer content and high inert filler content which is desirable for fire safety.

DETAILED DESCRIPTION OF THE INVENTION

The present invention is directed toward a carpet which can be die cut into tiles having very good dimensional stability through the use of an aqueous wet-laid sheet as the secondary backing. The wet-laid sheet comprises in pertinent part a filler material, latex binder, and fiber material wherein at least a portion of the fibrous material comprises dimensionally stable reinforcing fibers in an amount sufficient to provide dimensional stability.

Typically, the secondary backing material is prepared by an aqueous wet-laid process such as is disclosed in U.S. Pat. 4,225,383 and herein incorporated by reference. All percent weights are based on total composite sheet weight unless otherwise indicated. Sheets prepared in the wet-laid process are generally described as having from about 1 to about 30 percent total weight of a water-dispersible fiber such as cellulose fibers from 2 to about 30 percent total weight of a film-forming, water-insoluble, organic polymer as a binder material and from about 60 to about 95 percent total weight of a finely divided, substantially water-insoluble, non-fibrous, inorganic filler material. Less critical to the subject application as a carpet backing, however, is the inorganic filler content and, therefore, composite sheets having less than 60 percent total weight inorganic filler are acceptable. Also, cellulose fibers in an excess of 20 percent by weight tend to adversely affect the internal bond strength of the composite; therefore, preferably the cellulose fiber content is less than the 30 percent level, more preferred is a cellulose fiber level of from about 2 to about 15 percent by total weight. More critical to the subject application as a carpet backing material is that at least a portion of the fibrous content of the composite sheet must be of a dimensionally stable reinforcing material, such as glass fibers. Generally, at least 2 to about 15 percent based on the total weight of the subject composite comprises the dimensionally stable reinforcing fibers.

It has been discovered that the incorporation of a minor amount of a dimensionally stabilizing reinforcing fiber to the composite sheet gives a balance of physical properties acceptable for use in carpet backing, especially carpet tile backing. Therefore, an aqueous wet-laid composite sheet having from about 2 to about 15 percent, preferably 2 to about 10 percent based on the total weight of the composite sheet is suitable for the subject dimensionally stable carpet tiles.

The subject composite sheets are adhered to the greige goods (carpet woven fabric or looped fabric) by a latex adhesive, hot melt adhesive or other adhesive means. What is meant by greige goods is the cut or uncut loops of fabric filaments, or unwoven or woven fabric filaments which form all or part of the carpet surface. The fabric filaments can be woven, stitched or otherwise affixed to a primary backing. It is the underside of this primary backing, if present, to which the present composite sheet is affixed.

A latex or other adhesive material is applied by conventional means, i.e., blade coater, sprayer or hot melt extrusion to the underside of the greige good and the composite sheet is brought into contact with the latex adhesive. The entire assembly is then pressed and dried to permit intimate adhesion of the greige good to the composite sheet. The dried carpet assembly can then be die cut into appropriately sized tiles. The foregoing procedure can be conveniently carried out on a drum laminator or other application systems where the composite sheet and greige goods are not separated from each other while curing.

The dimensionally stable reinforcing fibers are meant to define fibrous materials which are resistant to change in dimension after being subjected to changes in conditions such as temperature and moisture. Sometimes this characteristic is referred to as "memory". For example, glass fibers are fibrous materials having very good dimensional stability. Whereas, nylon has a tendency to shrink upon being subjected to a heat treatment which makes nylon an undesirable fibrous material for purposes of this invention.

The preferred dimensionally stable reinforcing fibrous material employed in the subject composite sheets are generally glass fibers having a length of from about 0.01 to about 1.5 inches (0.25 to 38 mm) in length with a diameter of from about 0.0045 to about 0.0133 mm. While glass fibers are preferred, other comparable dimensionally stable fibrous materials can be employed. For example, mineral fibers such as graphite, carbon and silica or synthetic fibers such as polyester and aramid fibers can be employed.

Typically, polyester fibers having a length of about 0.04 to about 0.4 inch (1 to 10 mm), preferably 0.125 inch (3 mm), and a diameter of about 6 denier are preferred. Furthermore, combinations of various dimensionally stable fibers can be employed such as polyester and glass fibers.

While all fibers which have dimensional stability equivalent to glass fibers or better cannot be listed, it is generally recognized that those skilled in the art can readily determine if a particular reinforcing fiber would meet this requirement.

The dimensionally stable reinforcing fibers are employed in an amount sufficient to provide dimensional stability and internal strength to the backing. Dimensional stability is defined as an amount sufficient to give less than a 0.10 percent change on the Aachen Test and internal bond strength is defined as at least 50 gm/in. The Aachen Test is a standardized carpet backing stability test defined by the Aachen Institute in Europe for dimensional stability. The Aachen Test consists of dimensionally measuring a section of carpet which has been at room temperature for 24 hours. Then, the carpet is heated for 2 hours at 140° F., immersed in water for 2 hours at room temperature, removed from the water and heated for 24 hours at 140° F., then left at room temperature for 48 hours. After completing this sequence of conditions, the carpet section is again dimensionally measured and the change calculated.

Other additives can, of course, be employed in the composite sheet. These additives can include processing aids for the wet-laid process such as stabilizers, flocculating agents, and anti-foaming agents. Also, other additives can be added such as antioxidants, colorants, antistatic agents, plasticizers, and waxes.

Generally, the present composite sheet is from about, 0.1 to about 2.5 mm in thickness, preferably 0.5 to about 1.27 mm in thickness. The gauge or thickness is important to the necessary amount of material per unit area to provide dimensional stability. Therefore a minimum gauge of 0.25 mm is desirable. Gauges above this minimum add additional stability and body to the greige good. However, it is understood that varying percent composition of dimensionally stable reinforcing fibers with gauge can provide equal results but the ranges specified herein are deemed to be most applicable for providing the necessary stability, hand, and appearance for a commercially acceptable carpet tile. Also, the preferred gauges are most compatible with current engineering requirements for installation and maintenance of carpet tiles.

Carpet tiles according to the subject invention are further illustrated by the following examples. All percentages are based on the total weight of the composite sheet unless otherwise indicated.

EXAMPLE 1

A composite sheet having 15 percent latex (60.5 styrene/37.4 butadiene), 7.0 percent cellulose fibers, 74.5 percent talc and 3 percent dimensionally stable glass fibers was obtained having a gauge of 0.76 mm.

Various composite sheets were prepared to demonstrate the superiority of the subject composite sheet employed as a backing material. The compositions of the composite sheets tested are shown in Table I below.

TABLE I

| Backing | Latex (%) | Cellulose Fiber (%) | Reinforcing Fiber (%) | Gauge (mm) |
|---|---|---|---|---|
| A[1] | 15.0 | 7.5 | polyester 3.0 | .76 |
| B[1] | 13.0 | 12.0 | polyethylene 5.0 | .76 |
| C | 15.0 | 7.0 | glass 3.0 | .76 |
| D | 15.0 | 7.0 | glass 3.0 | .89 |
| E[1] | Action Back - Woven Polypropylene[2] | | | |

[1]not examples of the subject invention
[2]manufactured by the Amoco Company

Each of the backings were laminated with a latex adhesive to a standard greige good to form 9-by-9 and 8-by-8 inch carpet tile samples. The laminating technique employed was to hand coat the greige goods with a blade coater, apply the backing and allow to dry for seven minutes on a drum at 280° F. under sufficient pressure to maintain contact between the layers. The prepared tiles were then tested for percent dimensional change, i.e., Aachen Test. Each of the backing materials was evaluated using two different adhesives to see if this changed the dimensional stability. The first latex adhesive "X" had a viscosity of 7,000 centipoise and a polymer ratio of 26 styrene (36 butadiene/2 itaconic acid/36 vinylidene chloride) and the second latex adhesive "Y" had a viscosity of 20,000 centipoise and a polymer ratio of 33 styrene/65 butadiene/2 itaconic acid. The results are listed in Table II.

TABLE II

| Backing | % dimensional change "X" Adhesive | % dimensional change "Y" Adhesive |
|---|---|---|
| A[1] | −0.28/−0.18 | −0.41/−0.19 |
| B[1] | −0.19/−0.14 | −0.13/−0.12 |
| C | −0.09/−0.04 | −0.03/−0.01 |
| D | not tested | −0.01/zero |
| E[1] | −0.49/−0.05 | −0.71/−0.36 |

The data show that backings "C" and "D" were superior to all others. "C" and "D" each met the dimensional stability standard of less than a 0.1 percent change on the Aachen test. All other samples failed this dimensional stability test.

What is claimed is:

1. A dimensionally stable carpet tile having a greige good adhered to an aqueous wet-laid composite sheet comprising a dimensionally stable reinforcing fiber in an amount sufficient to provide less than a 0.10 percent dimensional change of said carpet tile on an Aachen Test.

2. The carpet tile of claim 1 wherein said dimensionally stable reinforcing fiber is present from about 2 to about 15 percent by weight based on total composite sheet.

3. The carpet tile of claim 1 wherein said composite sheet comprises, based on total weight composite sheet, from about 1 to about 30 percent cellulose fibers, from about 2 to about 30 percent organic polymer binder material, and from about 60 to about 95 percent inorganic filler.

4. The carpet tile of claim 3 where said composite sheet has an internal bond strength of at least 50 g/in.

5. The carpet tile of claim 3 where said composite sheet has from about 2 to about 15 percent by weight cellulose fibers and from about 2 to about 10 percent by weight of glass fibers.

6. The carpet tile of claim 1 where said composite sheet has an internal bond strength of at least 50 g/in.

7. The carpet tile of claim 1 where said composite sheet is from about 0.1 to about 2.5 mm in gauge.

8. The carpet tile of claim 1 where said dimensionally stable reinforcing fiber is a glass and/or polyester fiber.

* * * * *